US010223986B2

(12) United States Patent
Isono

(10) Patent No.: US 10,223,986 B2
(45) Date of Patent: Mar. 5, 2019

(54) TIMING CONTROLLER AND DISPLAY DEVICE

(71) Applicant: NLT Technologies, Ltd., Kanagawa (JP)

(72) Inventor: Katsuji Isono, Kanagawa (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 343 days.

(21) Appl. No.: 14/755,195

(22) Filed: Jun. 30, 2015

(65) Prior Publication Data

US 2016/0019848 A1 Jan. 21, 2016

(30) Foreign Application Priority Data

Jul. 3, 2014 (JP) ..... 2014-137323

(51) Int. Cl.

| | |
|---|---|
| ***G09G 3/20*** | (2006.01) |
| ***G09G 3/36*** | (2006.01) |
| ***G09G 5/00*** | (2006.01) |
| ***G09G 5/18*** | (2006.01) |

(52) U.S. Cl.

CPC ..... *G09G 3/3611* (2013.01); *G09G 3/2096* (2013.01); *G09G 5/005* (2013.01); *G09G 5/18* (2013.01); *G09G 2310/08* (2013.01); *G09G 2320/0257* (2013.01); *G09G 2320/04* (2013.01); *G09G 2330/06* (2013.01); *G09G 2330/12* (2013.01); *G09G 2370/08* (2013.01)

(58) Field of Classification Search

None

See application file for complete search history.

(56) References Cited

U.S. PATENT DOCUMENTS 5,781,185 A * 7/1998 Shin ..... G09G 5/005 345/204
2006/0071891 A1 4/2006 Anai
2007/0018932 A1* 1/2007 Takaki ..... G09G 3/3688 345/98

(Continued)

FOREIGN PATENT DOCUMENTS

JP 06-105262 4/1994
JP 2006-098923 4/2006

(Continued)

*Primary Examiner* — Matthew Yeung
(74) *Attorney, Agent, or Firm* — Young & Thompson

(57) ABSTRACT

When applying exogenous noise with a synchronizing signal or a transmission clock period, influence by the applied noise is inhibited from appearing on a liquid crystal display, without increasing circuit size. There are included: a timing controller generating a control signal of a scanning line driving gate driver and a control signal of a signal line driving source driver based on an input signal to be a reference inputted from the outside; an enable signal generation unit including a noise detecting circuit for detecting various items of noise entering the input signal and outputs an enable signal for turning OFF or ON the output of a gate driver control signal for a predetermined period based on output from the noise detecting circuit; and an image data output control circuit when detecting noise synchronized in a vertical period. The gate driver control signal is controlled to have an idle period.

12 Claims, 18 Drawing Sheets

(56) References Cited

U.S. PATENT DOCUMENTS

| | | | | |
|---|---|---|---|---|
| 2008/0094388 | A1* | 4/2008 | Yamazaki | G09G 3/3655<br>345/212 |
| 2011/0018845 | A1* | 1/2011 | Mizunaga | G09G 3/3677<br>345/204 |

FOREIGN PATENT DOCUMENTS

| | | |
|---|---|---|
| JP | 2008-241828 | 10/2008 |
| JP | 2009-109955 | 5/2009 |

* cited by examiner

TIMING CONTROLLER AND DISPLAY DEVICE

BACKGROUND OF THE INVENTION

Field of the Invention

The present invention relates to timing controllers and display devices. In particular, the present invention relates to a timing controller and a display device, which can inhibit an influence by applied exogenous noise from appearing on a liquid crystal display when the exogenous noise such as exogenous noise synchronizing with a synchronizing signal (such as HSYNC, VSYNC, or DE) or a transmission clock period is applied, and can be achieved without enlarging the size of a circuit.

Description of the Related Art

A timing controller for a liquid-crystal display device generates a control signal for a liquid crystal driving sorting driver and a liquid crystal driving gate driver based on a reference signal, such as HSYNC (horizontal synchronizing signal), VSYNC (vertical synchronizing signal), or DE (composite synchronizing signal), input into a liquid-crystal display device. Therefore, an incorrect control signal may be outputted, and a malfunction in which noise is generated or a screen is changed on a liquid crystal display may be caused when exogenous noise such as static electricity is mixed into a reference signal during display action.

Conventional timing controllers have had many configurations in which superimposition of noise synchronizing with each synchronizing signal and transmission clock period on synchronizing signals and image data fed from the outside has such an influence on the display of liquid-crystal display devices that the noise is recognized as a normal signal or a black screen is outputted depending on the size of the noise. In recent years, the number of users performing evaluation in which noise is intentionally introduced from the outside has been increased, so that immunity to synchronizing noise and the like has been needed.

FIG. 4 illustrates the configuration of a timing controller 12 in a conventional liquid-crystal display device, and FIG. 5 illustrates a conventional liquid-crystal display device 1.

In FIG. 5, the conventional liquid-crystal display device 1 includes: a liquid crystal display 2 including a plurality of scanning line electrodes 18 disposed at predetermined spacings in an X-direction, a plurality of signal line electrodes 17 disposed at predetermined spacings in a Y-direction, liquid crystal cells 51 that are sandwiched between the electrodes so that the electrodes intersect each other and that have equivalently formed capacitive loads, common electrodes (not illustrated), thin film transistors (TFTs) 50 for driving the corresponding liquid crystal cells 51, and capacitors 52 that accumulates data charge during one vertical synchronization period; a signal line electrode driving circuit 6 including one or more signal line driving source drivers IC8; a scanning line electrode driving circuit 3 including one or more scanning line driving gate drivers IC9; and a timing controller 12.

In FIG. 4, the timing controller 12 for a conventional display device includes: a receiver circuit unit 14 for synchronizing each synchronizing signal of HSYNC, VSYNC, and DE fed from the outside and an image data signal fed from the outside with a CLK signal fed from the outside; a timing generation unit 13 that generates a control signal VSP for driving a scanning line driving gate driver IC9 and a signal line driving source driver IC8 (start pulse signal for scanning line driving gate driver IC), VCK (clock signal for scanning line driving gate driver IC), a signal VOE for output control of a scanning line driving gate driver IC9 (output enable signal for scanning line driving gate driver IC), HSP (start pulse signal for signal line driving source driver IC), DLP (data latch pulse signal for signal line driving source driver IC), and POL (alternate-current driving polarity reversion signal); and an image data processing unit 15 that processes image data fed from the outside. Each synchronizing signal and image data outputted from the receiver circuit unit 14 are signals synchronized with CLK (clock signal) fed from the outside.

The timing controller 12 outputs the image data for each driver and the control signal VOE described above from timing information for display, based on a synchronizing signal, such as a clock (hereinafter "CLK") or horizontal synchronizing signal (hereinafter "HSYNC"), a vertical synchronizing signal (hereinafter "VSYNC"), or a composite synchronizing signal (hereinafter "DE"), and image data, fed from the outside.

In the signal line electrode driving circuit 6, each signal line driving source driver IC8 takes image data at the timing of HSP (start pulse signal for signal line driving source driver IC), DLP (data latch pulse signal for signal line driving source driver IC), POL (alternate-current driving polarity reversion signal), and CLK outputted from the timing controller 12, and each item of image data in each pixel corresponding to one line is converted into a voltage value, which is fed to a pixel electrode in a panel for liquid crystals, corresponding to one line through a drain electrode in TFT.

The scanning line driving gate driver IC9 of the scanning line electrode driving circuit 3 controls all scanning line electrodes of each TFT as described above on a one-line basis in synchronism with a VCK signal based on VSP (start pulse signal for scanning line driving gate driver IC), VCK (clock signal for scanning line driving gate driver IC), and VOE (output enable signal for scanning line driving gate driver IC) outputted from the timing controller 12 and applies a gradation voltage, fed from the signal line driving source driver 8 at the time of conduction, to a pixel electrode by starting the sequential conduction of each TFT corresponding to one line in an upper or lower portion in the Y-direction.

In order to drive the liquid-crystal display device 1 as described above, synchronizing signals such as HSYNC, VSYNC, and DE are required for the timing controller 12, and a control signal for the scanning line driving gate driver IC9 and a control signal for a signal line driving source driver IC8 are generated from the synchronizing signals. Therefore, when external noise is superposed on synchronizing signals such as HSYNC, VSYNC, DE, and CLK, the control signals for the scanning line driving gate driver IC9 and the signal line driving source driver IC8 are synchronized with the incorrect synchronizing signals, on which the noise is superimposed, and therefore differ from normal control signals. When the control signals differ from a normal state, a phenomenon such as a display moved upward and downward with respect to a liquid crystal display (hereinafter "V synchronization displacement"), a display in which lines are horizontally formed (hereinafter "line noise"), the flicker of a screen (hereinafter "screen flash"), or stopping of a screen with a certain fixed color (hereinafter "fixed-colored screen display) is caused (hereinafter "malfunction state").

CITATION LIST

Patent Literature

[Patent Literature 1] Japanese Patent Laid-Open No. 2008-241828

[Patent Literature 2] Japanese Patent Laid-Open No. 2006-98923

[Patent Literature 3] Japanese Patent Laid-Open No. 2009-109955

[Patent Literature 4] Japanese Patent Laid-Open No. 06-105262

In a general method for preventing such a malfunction state and a noise screen as described above, noise is prevented from propagating in a timing controller 12 by disposing a noise filter for each synchronizing signal of HSYNC, VSYNC, DE, and CLK, to achieve normal action of a control signal for a scanning line driving gate driver IC9 and a signal line driving source driver IC8. However, only the disposition of the noise filter does not make it possible to completely improve the malfunction state when noise is synchronized with each synchronizing signal at timing where the noise is superimposed. Technologies to use a noise filter in order to prevent false recognition of a synchronizing signal due to exogenous noise in a timing controller 12 used in a liquid-crystal display device are disclosed in, for example, Japanese Patent Laid-Open No. 2008-241828 (Patent Literature 1), Japanese Patent Laid-Open No. 2006-98923 (Patent Literature 2), and Japanese Patent Laid-Open No. 2009-109955 (Patent Literature 3). In the literatures, noise is detected being superimposed on a synchronizing signal, and the output enable (VOE) of a scanning line driving gate driver IC9 is controlled to OFF when the noise is detected, to prevent a voltage from being applied from a signal line driving source driver IC8 to TFT. Since it is impossible to remove noise through a filter from image data outputted from a signal line driving source driver IC8, it is necessary to prevent the noise from being displayed on a liquid crystal display. Since the noise is detected being superimposed on the synchronizing signal, it is considered that the image data on which the noise is superposed is also outputted for the output of the signal line driving source driver IC8 when it is considered that the noise is also superposed on the image data. Accordingly, in the methods, the image data on which the noise is superposed is prevented from being applied to TFT by setting the output enable of the scanning line driving gate driver IC9 at OFF, and the noise superimposed on the image data is inhibited from appearing by keeping a voltage applied to TFT prior to the application of the noise.

However, the methods are based on the assumption that mainly superimposed noise is randomly generated. For example, when exogenous noise as synchronizing with a synchronizing signal (such as HSYNC, VSYNC, or DE) or a transmission CLK period is applied, the output of the scanning line driving gate driver IC9 always becomes OFF only during a period in which the noise is superimposed, and therefore, a potential applied to TFT is gradually self-discharged. There is a problem that as a result, when a luminance difference appears in a line in scanning line driving, in which the output is OFF, the line is seen as noise.

Since it is impossible to remove noise superimposed on image data through a filter as mentioned above, image data for being supplemented as the image data in the application of the noise is separately needed. Japanese Patent Laid-Open No. 06-105262 (Patent Literature 4) discloses a method for detecting the degradation of image data and displaying the data of a frame before degrading without being processed; however, there is a problem that since a frame memory for saving the data of the frame is needed, the size of a circuit is increased, and increase in current and the like occur. In addition, there is a problem that drive in the same place is stopped due to synchronizing noise, whereby alternate-current drive is stopped, a direct-current component remains, the synchronizing noise then disappears, and a ghost, an afterimage, or the like is produced in the case of returning to normal driving.

An objective of the present invention is to achieve, in the case of applying exogenous noise as synchronizing with a synchronizing signal (such as HSYNC, VSYNC, or DE) or a transmission CLK period, inhibition of an influence by the applied noise from appearing on a liquid crystal display without increasing the size of a circuit.

SUMMARY OF THE INVENTION

In accordance with the present invention, the output enable (VOE) of a scanning line driving gate driver IC9 is prevented from being always in an OFF state by detecting noise detected in a noise detecting circuit 30 synchronizing with a synchronizing signal or a transmission CLK period. Since it is necessary to cancel the OFF state of the output enable (VOE) of the scanning line driving gate driver IC9 when the detected noise is detected synchronizing with the synchronizing signal or the transmission CLK period, it is further needed to inhibit noise superimposed on image data from appearing. In accordance with the present invention, image data corresponding to three lines is saved using a line memory rather than a frame memory. When noise is detected, line data in which the noise is generated is supplemented using data before a line, in which the noise is detected, by one line, and data following a line in which the noise is detected, whereby the noise can be inhibited from appearing.

In accordance with the present invention, installation of, in addition to a conventional noise filter, a filter for synchronous detection makes it possible to deal with various types of noise. In particular, by avoiding stop of driving in the same place due to synchronizing noise, alternate-current drive can be continued to avoid display degradation such as a ghost or an afterimage. In addition, the function of controlling image data in application of noise makes it possible to reduce an influence on a liquid crystal display.

DETAILED DESCRIPTION OF THE PREFERRED EMBODIMENTS

Example 1

Figure 1:
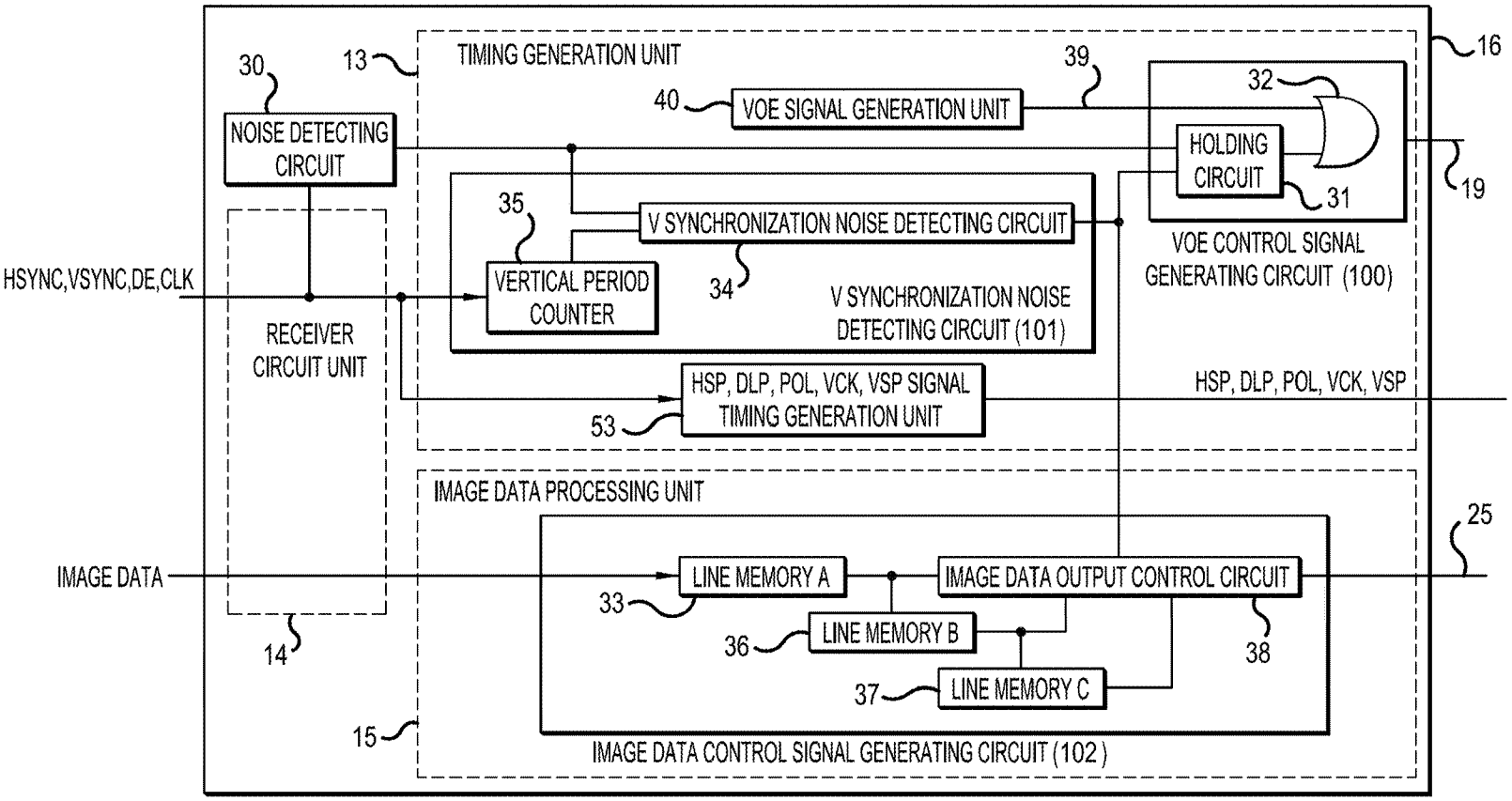
FIG. 1 is a configuration diagram of a timing controller in Example 1 of a display device according to the present invention.
Figure 2:
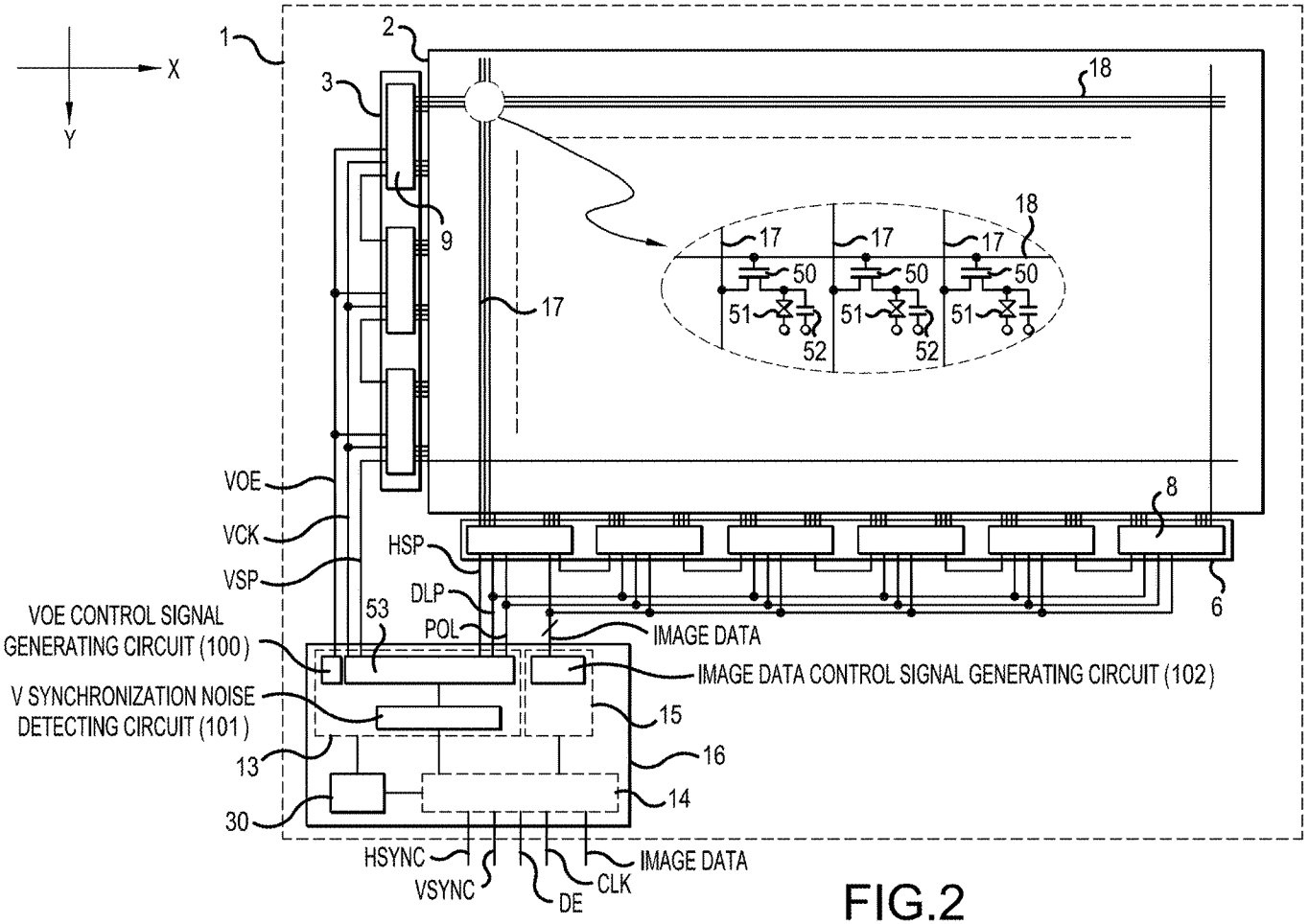
FIG. 2 is a configuration diagram of a liquid-crystal display device in Example 1 of a display device according to the present invention.

FIG. 1 illustrates the configuration of a timing controller for a display device which is one of the examples of the present invention, and FIG. 2 illustrates the configuration of a liquid-crystal display device which is one of the examples of the present invention.

In FIG. 2, a liquid-crystal display device 1 of the present invention includes: a liquid crystal display 2 including a plurality of scanning line electrodes 18 disposed at predetermined spacings in an X-direction, a plurality of signal line electrodes 17 disposed at predetermined spacings in a Y-direction, liquid crystal cells 51 that are sandwiched between the electrodes so that the electrodes intersect each other and that have equivalently formed capacitive loads, common electrodes (not illustrated), thin film transistors (TFTs) 50 for driving the corresponding liquid crystal cells, and capacitors 52 that accumulates data charge during one vertical synchronization period; a signal line electrode driving circuit 6 including one or more signal line driving source drivers IC8; a scanning line electrode driving circuit 3 including one or more scanning line driving gate drivers IC9; and a timing controller 16.

In FIG. 1 and FIG. 2, the liquid-crystal timing controller 16 of the present invention includes: a noise detecting circuit 30 for detecting noise for a synchronizing signal such as HSYNC, VSYNC, or DE fed from the outside; a holding circuit 31 for holding a signal at a High level after detection of noise; a control signal VOE39 for a scanning line driving gate driver IC9 generated from the synchronizing signal; a VOE control signal generating circuit 100 including a circuit for OR of signals from the holding circuit 31 and the control signal VOE39; a V synchronization noise detecting circuit 101 including a V synchronization noise detecting circuit 34 for detecting a line, in which noise is generated, using a vertical period counter 35 for measuring the number of effective lines from the synchronizing signal; a line memory A33, a line memory B36, and a line memory C37 for storing image data fed from the outside in each line; an image data control signal generating circuit 102 including an image data output control circuit 38 for controlling image data stored in the line memory A33, the line memory B36, and the line memory C37 in each detection of V synchronism noise; and a timing generation unit 53 for generating an HSP signal for a signal line driving source driver, a DLP signal, a VCK signal for a scanning line driving gate driver, a VSP signal, and a polarity reversion signal POL for alternate-current-driving a liquid crystal display. Only any one of the synchronizing signals of HSYNC, VSYNC, and DE fed from the outside may also be fed, or DE may also be generated from the signals of HSYNC and VSYNC.

The timing controller 16 outputs the image data for each driver and the control signal from timing information for display, based on a synchronizing signal, such as a clock or horizontal synchronizing signal (hereinafter "HSYNC"), a vertical synchronizing signal (hereinafter "VSYNC"), or a composite synchronizing signal (hereinafter "DE"), and image data, fed from the outside. The timing controller of the present invention mainly includes a noise detecting circuit, a VOE control signal generating circuit 100, a V synchronization noise detecting circuit 101, and the image data control signal generating circuit 102.

In the signal line electrode driving circuit 6, which has a multiple-stage configuration in which signal line driving source drivers IC are connected in series, each signal line driving source driver takes image data at the timing of an HSP signal, a DLP signal, a POL signal, and a DCK signal outputted from the timing controller 16, and each item of image data in each pixel corresponding to one line is converted into a voltage value, which is fed to a pixel electrode in a liquid crystal panel, corresponding to one line through a drain electrode in TFT.

The scanning line driving gate driver IC9 of the scanning line electrode driving circuit 3 controls all scanning line electrodes of each TFT as described above on a one-line basis in synchronism with a VCK signal based on a VSP signal, a VOE signal, and a VCK signal outputted from the timing controller 16 and applies a gradation voltage, fed from the signal line driving source driver at the time of conduction, to a pixel electrode by starting the sequential conduction of each TFT corresponding to one line in an upper or lower portion.

The action of the timing controller of the present invention will be described below.

Figure 3:
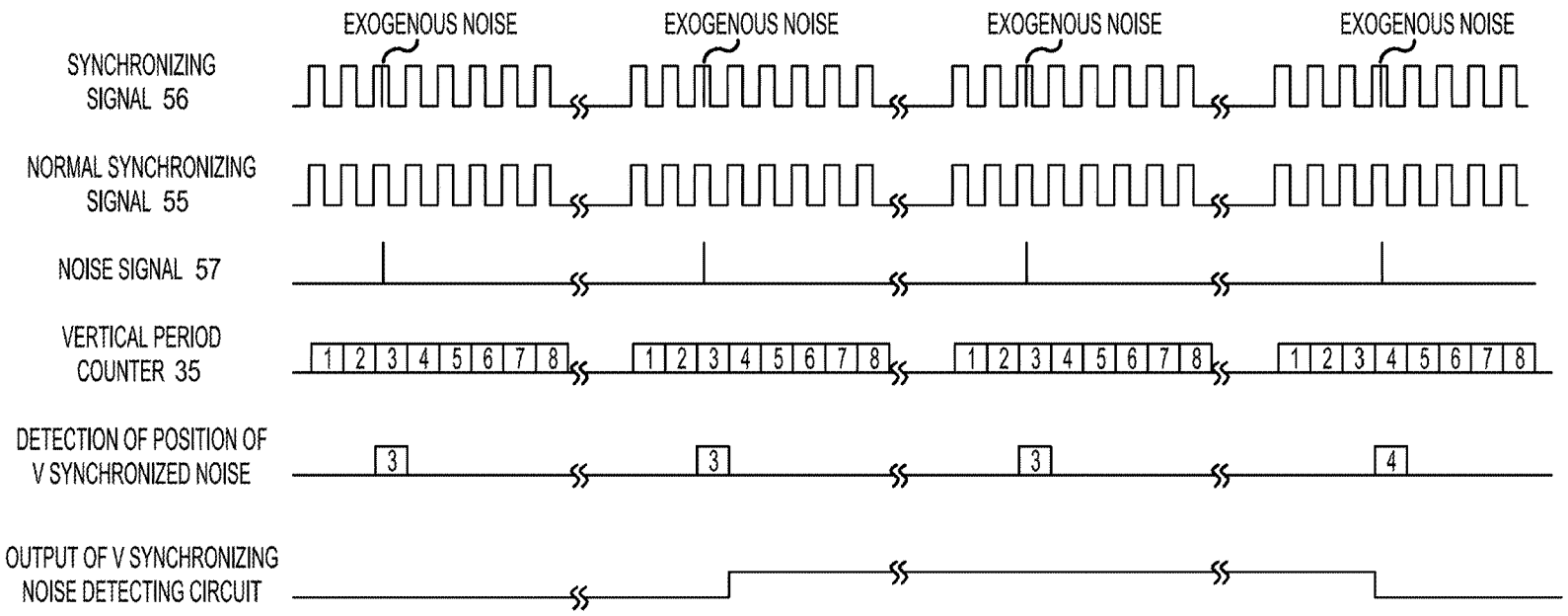
FIG. 3 is an action timing chart of Example 1 of a display device according to the present invention.
Figure 4:
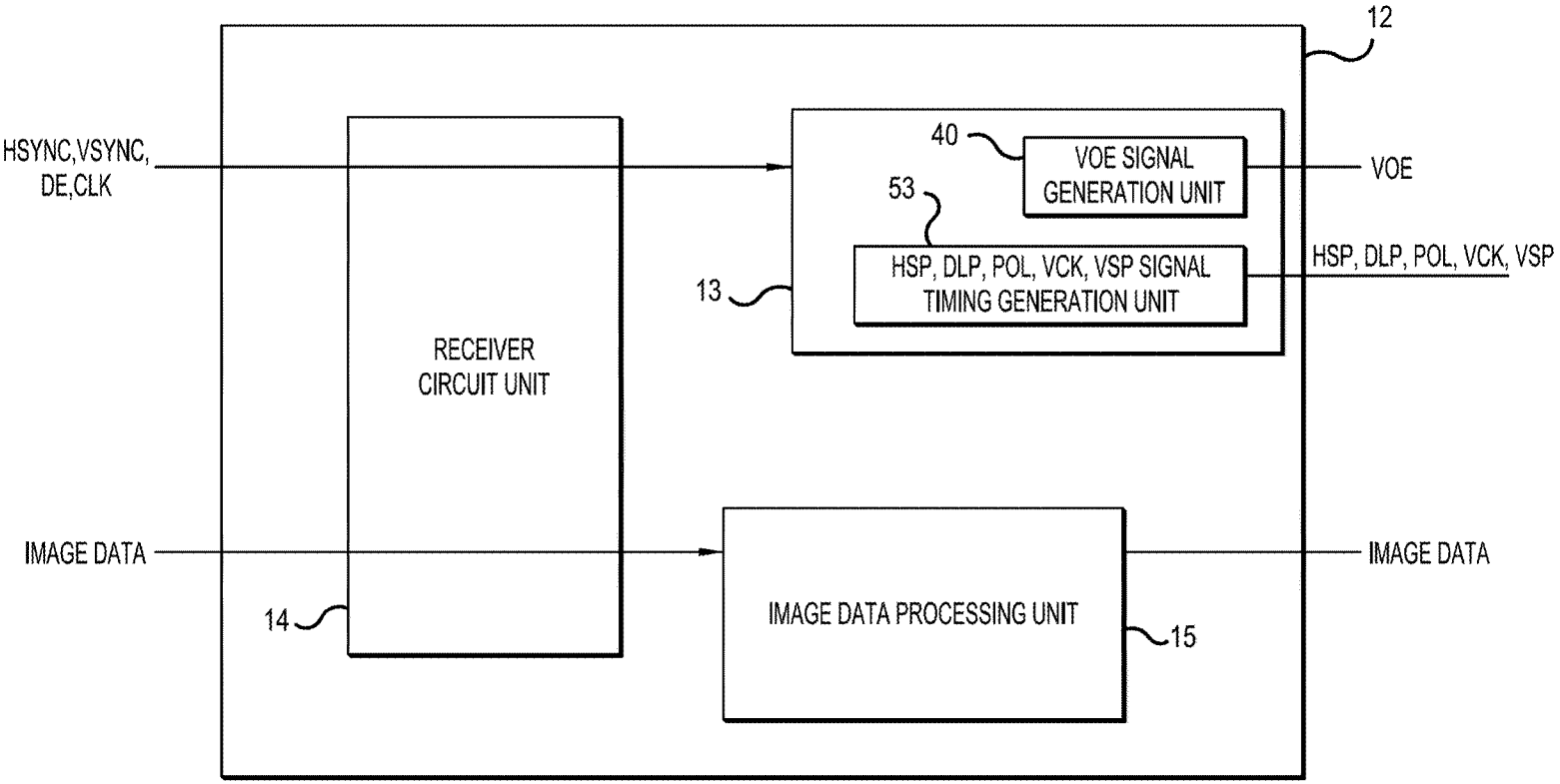
FIG. 4 is a configuration diagram of a conventional timing controller.
Figure 5:
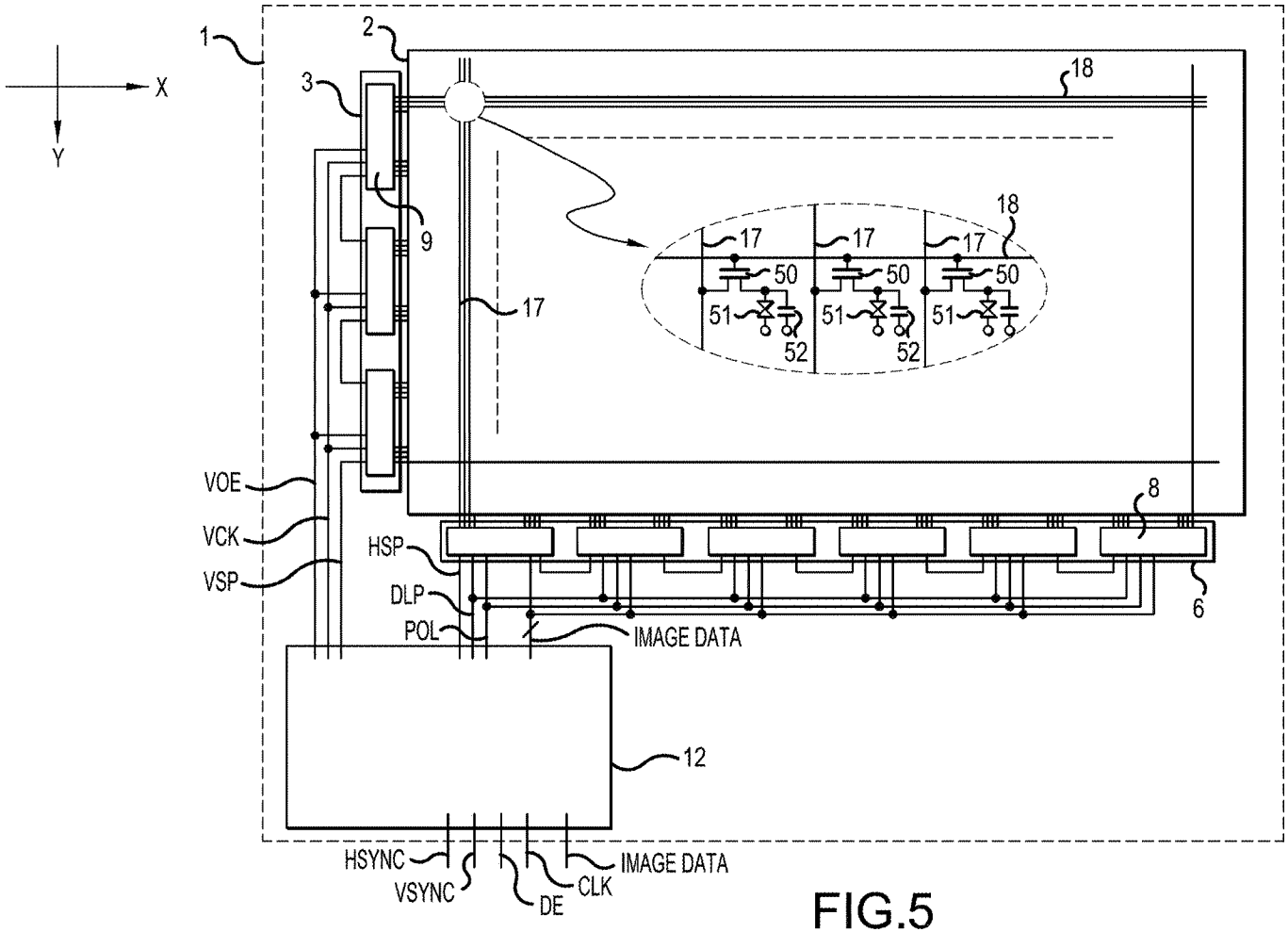
FIG. 5 is a configuration diagram of a conventional liquid-crystal display device.

First, a method for controlling the control signal VOE of the scanning line driving gate driver IC9 is explained. The timing chart of action is illustrated in FIG. 3. The explanation is given below with reference to FIG. 3.

The timing controller 16 which is one of the examples of the present invention first requires a noise detecting circuit 30 in order to detect noise superimposed on each synchronizing signal of HSYNC, VSYNC, and DE fed from the outside.

The noise detecting circuit 30 generates a normal synchronizing signal 59 for display resolution, within its inside, for example, to a synchronizing signal fed from the outside at a change point, where a signal is switched to from 0 to 1, as a trigger. Noise detection can be achieved by recognizing, as noise, a change at timing that is not timing where a normal change occurs, by comparing the normal synchronizing signal 59 with a synchronizing signal 56 fed from the outside. In accordance with the present invention, a V synchronization noise detecting circuit 34 is further required.

The V synchronization noise detecting circuit 34 carries out measurement by detecting a line in which a noise signal 57 detected in the noise detecting circuit 30 is generated. A vertical period counter 35 is required for measuring a vertical period using the normal synchronizing signal 59 in order to detect the line in which the noise signal is generated. The line in which the noise is generated using the timing of the noise signal 57 detected in the noise detecting circuit 30 and the vertical period counter 35 is detected, and it is detected whether multiple items of noise are generated on the same line.

Furthermore, in accordance with the present invention, the output enable control signal VOE19 of a scanning line driving gate driver IC9 is controlled to control the application, to a pixel electrode, a gradation voltage fed from a signal line driving source driver IC8 at the time of conduction. Therefore, the output enable control signal VOE19 of the scanning line driving gate driver IC9 is turned OFF at each timing of generation of noise detected in the noise detecting circuit 30, and the gradation voltage fed from the signal line driving source driver IC8 at the time of conduction is prevented from being applied to the pixel electrode. Furthermore, the output enable control signal VOE19 of the scanning line driving gate driver IC9 is turned ON at the timing of detecting multiple items of noise, in the same line, detected in a V synchronization noise detecting circuit 101, and the gradation voltage fed supplied from the signal line driving source driver IC8 at the time of conduction is applied to the pixel electrode.

A method for controlling image data will be described below.

Since image data is fed from the outside, noise may be superimposed on the image data in such a manner as in the case of synchronizing signals. However, the noise is not able to be detected or removed through a filter because of depending on display data. In the present invention, first, image data on an Nth line fed from the outside is stored in a line memory A33. The line memory A33 is fed to a line memory B36 and an image data output control circuit 38 without being processed. As a result, the line memory A33 can newly store image data on an (N+1)th line. The line memory B36 is similarly fed to a line memory C37 and the image data output control circuit 38. In such a manner, image data on an (N+2)th line, the image data on the (N+1)th line, and the image data on the Nth line are stored in the line memory A33, the line memory B36, and the line memory C37, respectively, and the image data corresponding to the three lines can be saved in the timing controller 16. The image data output control circuit 38 allows data fed from the outside to control output image data 25 at the timing of detection in the V synchronization noise detecting circuit 101. As a control method, for example, outputs from the line memory A33, the line memory B36, and the line memory C37 can be averaged to achieve the outputs.

Figure 16:
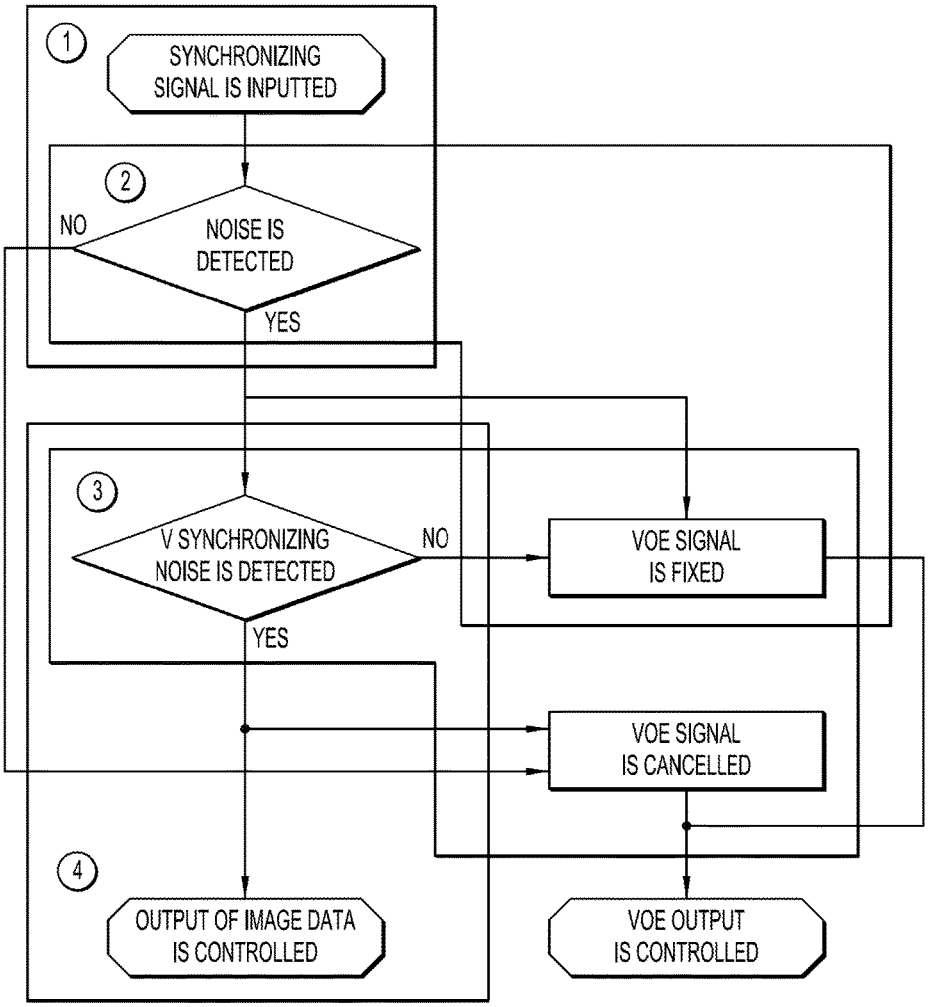
FIG. 16 is a flowchart of Example 1 of a display device according to the present invention.

A method for inhibiting noise from appearing on a liquid crystal display in the case of superposing the noise synchronized with a synchronizing signal is described below. A flowchart is illustrated in FIG. 16.

The output enable control signal VOE19 generated from the VOE control signal generating circuit 100 and V synchronization noise detecting circuit 101 mentioned above and an image data signal 26 generated in the image data control signal generating circuit 102 are required. The flow of the action will be described below.

(1) When noise is superposed on each synchronizing signal of HSYNC, VSYNC, and DE fed from the outside, the noise is detected by the noise detecting circuit 30.

(2) The signal of the output enable control signal VOE19 is fixed at High or Low by detecting the noise. The output enable can be turned OFF by the fixation.

(3) The noise for each synchronizing signal of HSYNC, VSYNC, and DE fed from the outside is noise on each synchronizing signal or transmission CLK period, the High or Low fixation of the signal of the output enable control signal VOE19 is canceled by the V synchronization noise detecting circuit 101.

(4) As for data on which noise is superposed on image data on the liquid crystal display, a gradation voltage is fed from the signal line driving source driver IC8 at the time of conduction is applied to a pixel electrodes by the canceling, and therefore, the image data on which the noise is superimposed is supplemented with image data outputted from the image data control signal generating circuit 102.

In the present example, the example in which the timing controller of the present invention is applied to the liquid-crystal display device is described in FIG. 2. However, the timing controller can be applied to other display devices such as organic EL and electronic papers without being limited to the liquid-crystal display device.

In such a manner, a malfunction state in the case of superimposing noise synchronized in each synchronizing signal is avoided, and noise on a liquid crystal display is inhibited from appearing.

Example 2

Figure 6:
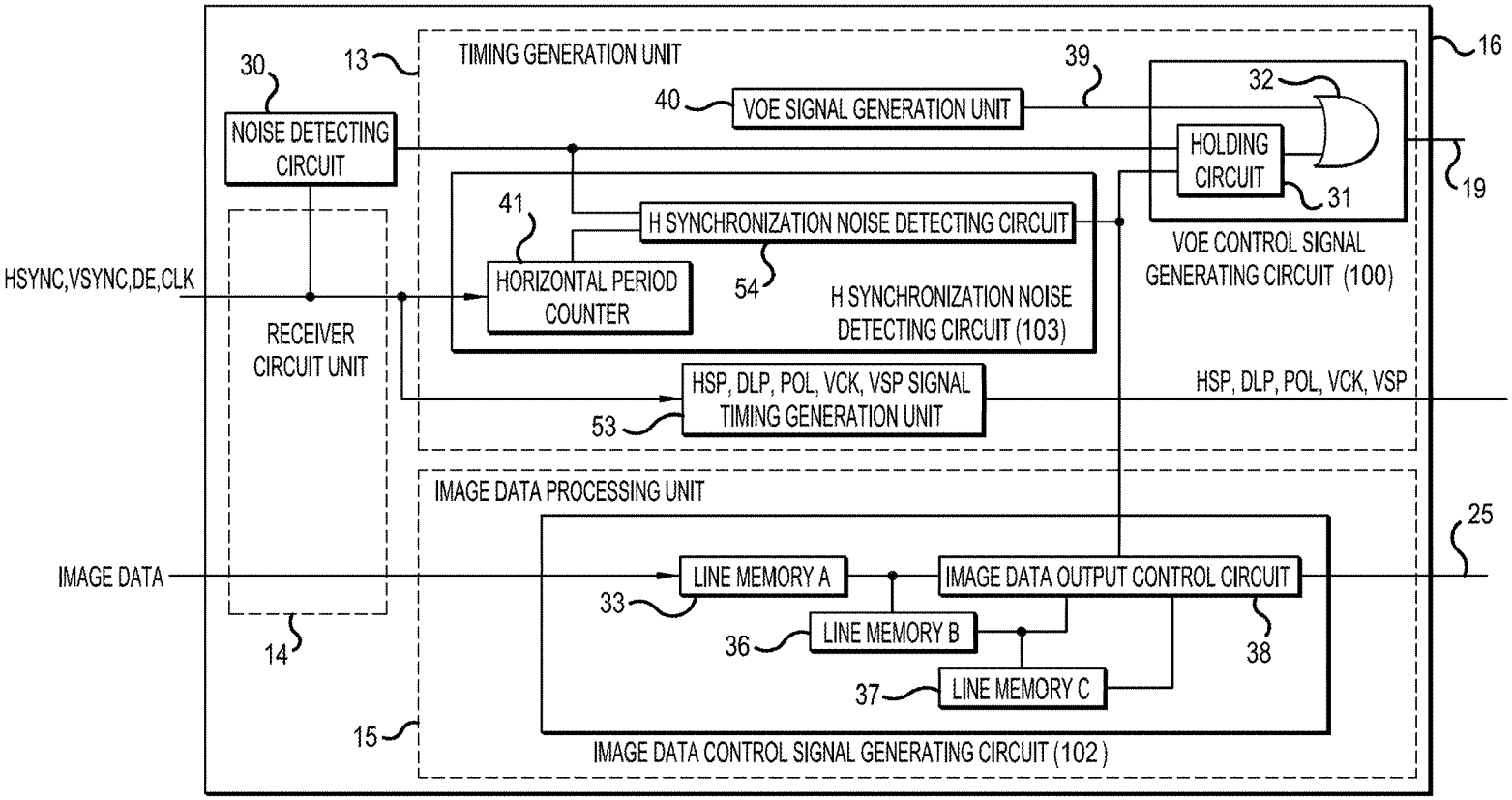
FIG. 6 is a configuration diagram of a timing controller in Example 2 of a display device according to the present invention.

FIG. 6 illustrates the configuration of a timing controller 16 in Example 2 of the present invention.

In FIG. 6, in the timing controller 16 of the present invention, the vertical period counter is used in Example 1 as mentioned above in order to detect a signal with which noise is synchronized from each synchronizing signal fed from the outside whereas V synchronization noise is detected in this case. Thus, an H synchronization noise detecting circuit 103 is included by replacing the vertical period counter with a horizontal period counter 41 and replacing the V synchronization noise detecting circuit 34 with an H synchronization noise detecting circuit 54, whereby a VOE signal and an image data output can be controlled as in Example 1 mentioned above.

Example 3

Figure 7:
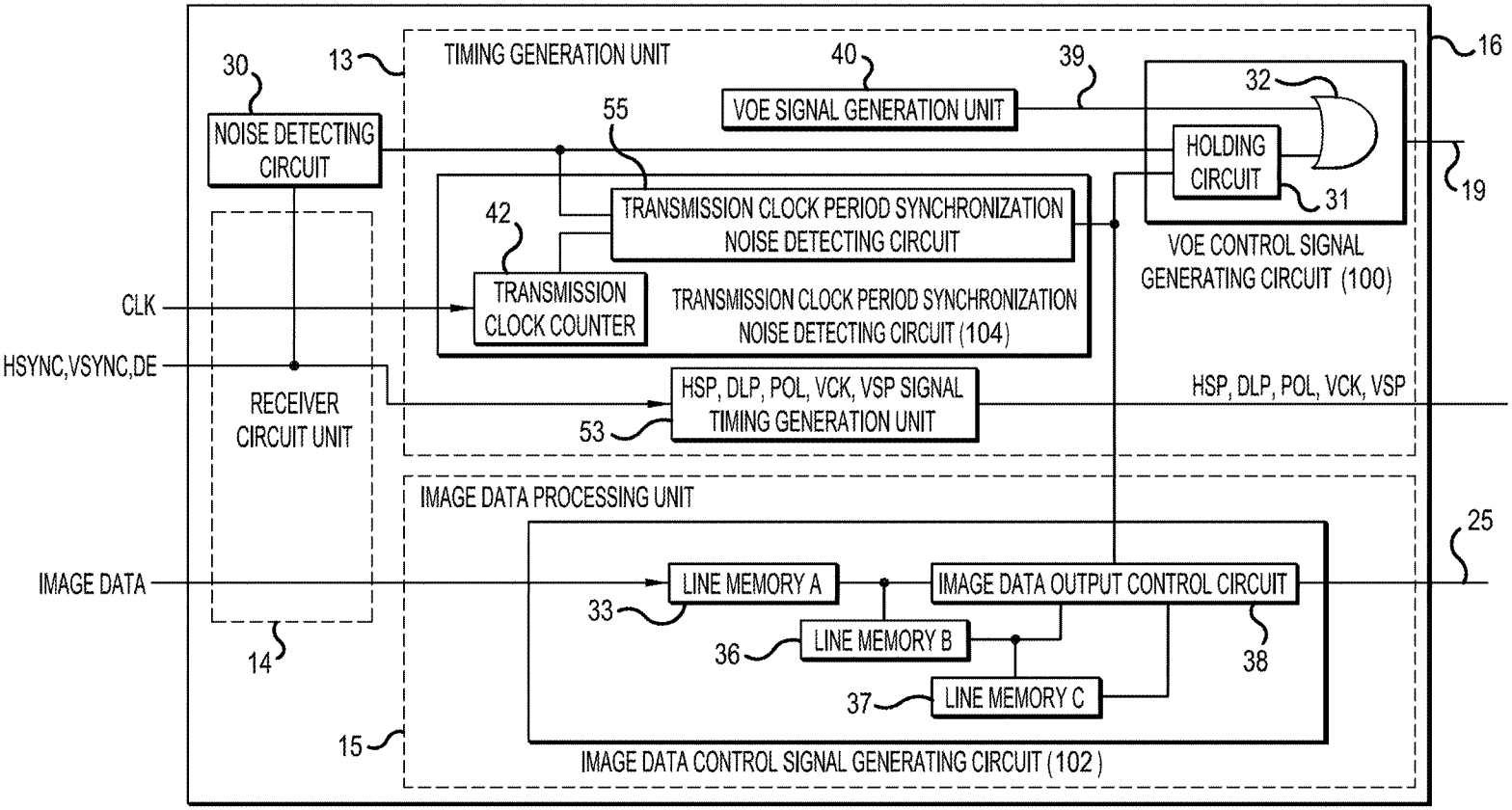
FIG. 7 is a configuration diagram of a timing controller in Example 3 of a display device according to the present invention.

FIG. 7 illustrates the configuration of a timing controller 16 in Example 3 of the present invention.

In FIG. 7, in the timing controller 16 of the present invention, a transmission clock period synchronization noise detecting circuit 104 is included by replacing the vertical period counter with a transmission clock counter 42 and replacing the V synchronization noise detecting circuit 34 with a transmission clock period synchronization noise detecting circuit 55 in order to detect a signal with which noise is synchronized from each synchronizing signal fed from the outside, whereby a VOE signal and an image data output can be controlled as in Example 1 mentioned above.

Example 4

Figure 8:
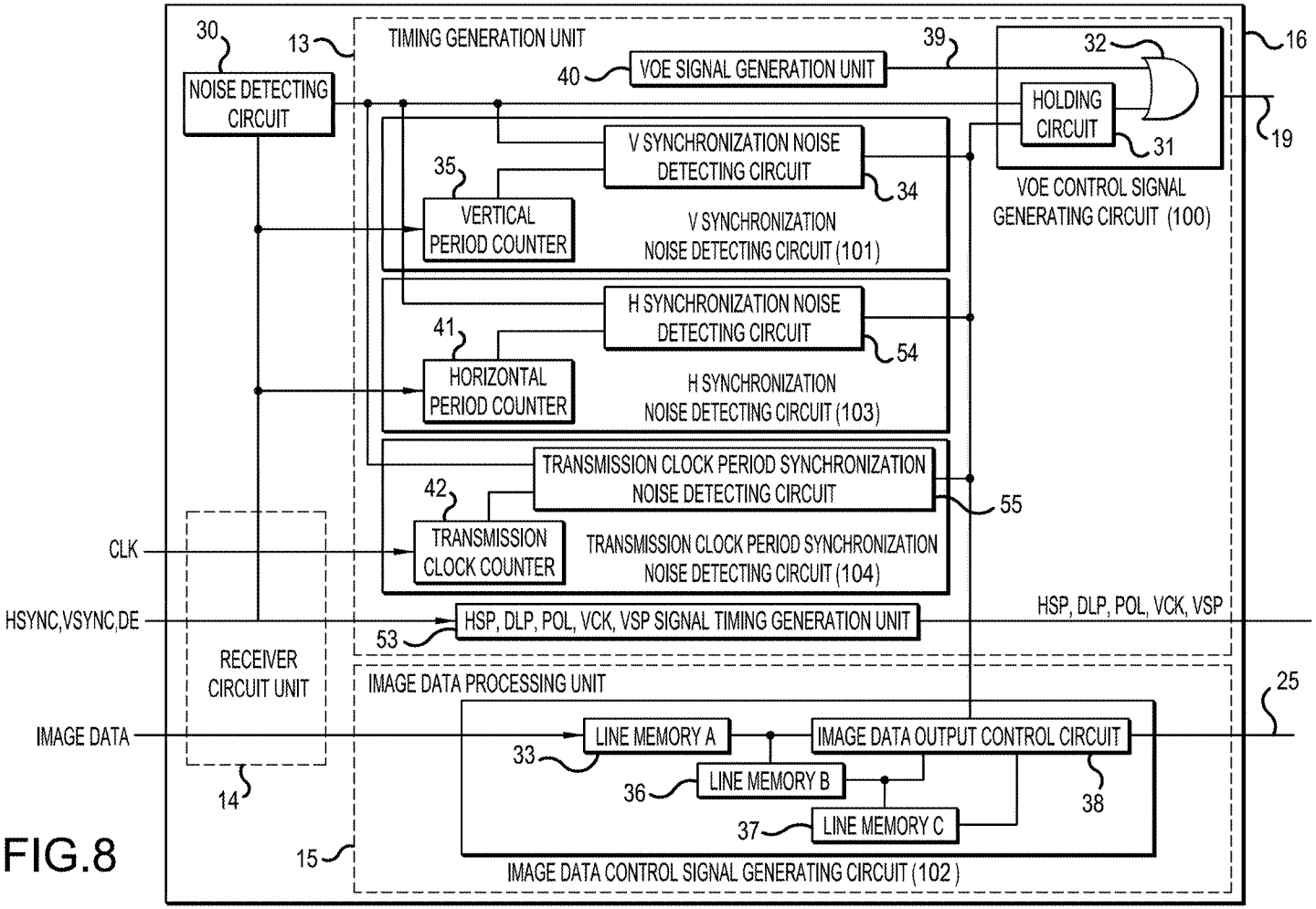
FIG. 8 is a configuration diagram of a timing controller in Example 4 of a display device according to the present invention.

FIG. 8 illustrates the configuration of a timing controller 16 in Example 4 of the present invention.

In FIG. 8, the V synchronization noise detecting circuit 101 included in Example 1 as mentioned above, the H synchronization noise detecting circuit 103 included in Example 2, and the transmission clock period synchronization noise detecting circuit 104 for included in Example 3 are simultaneously included, whereby noise synchronized with each synchronizing signal and transmission clock can be detected.

Figure 11:
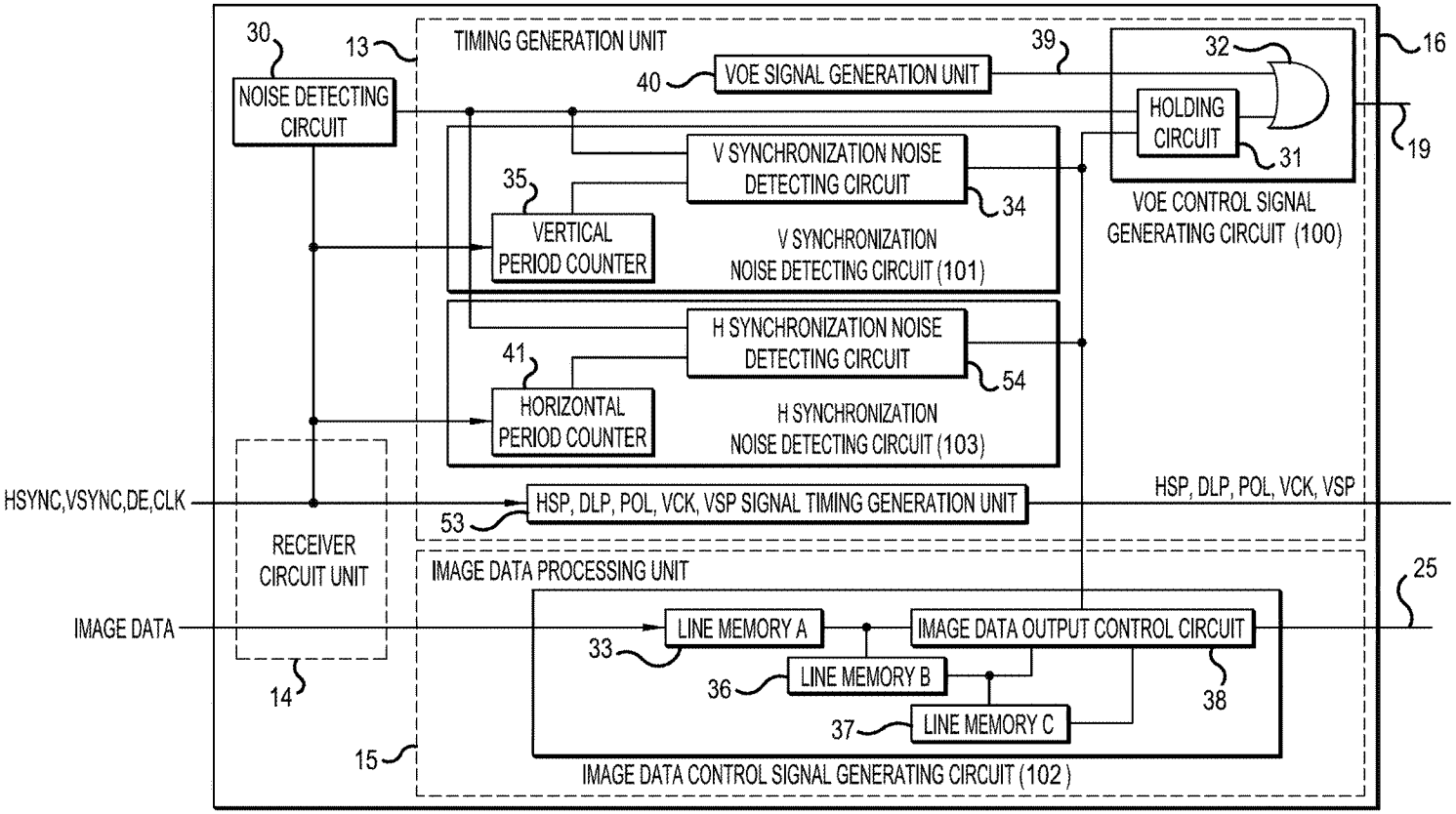
FIG. 11 is a configuration diagram of the timing controller in Example 4 of a display device according to the present invention.
Figure 12:
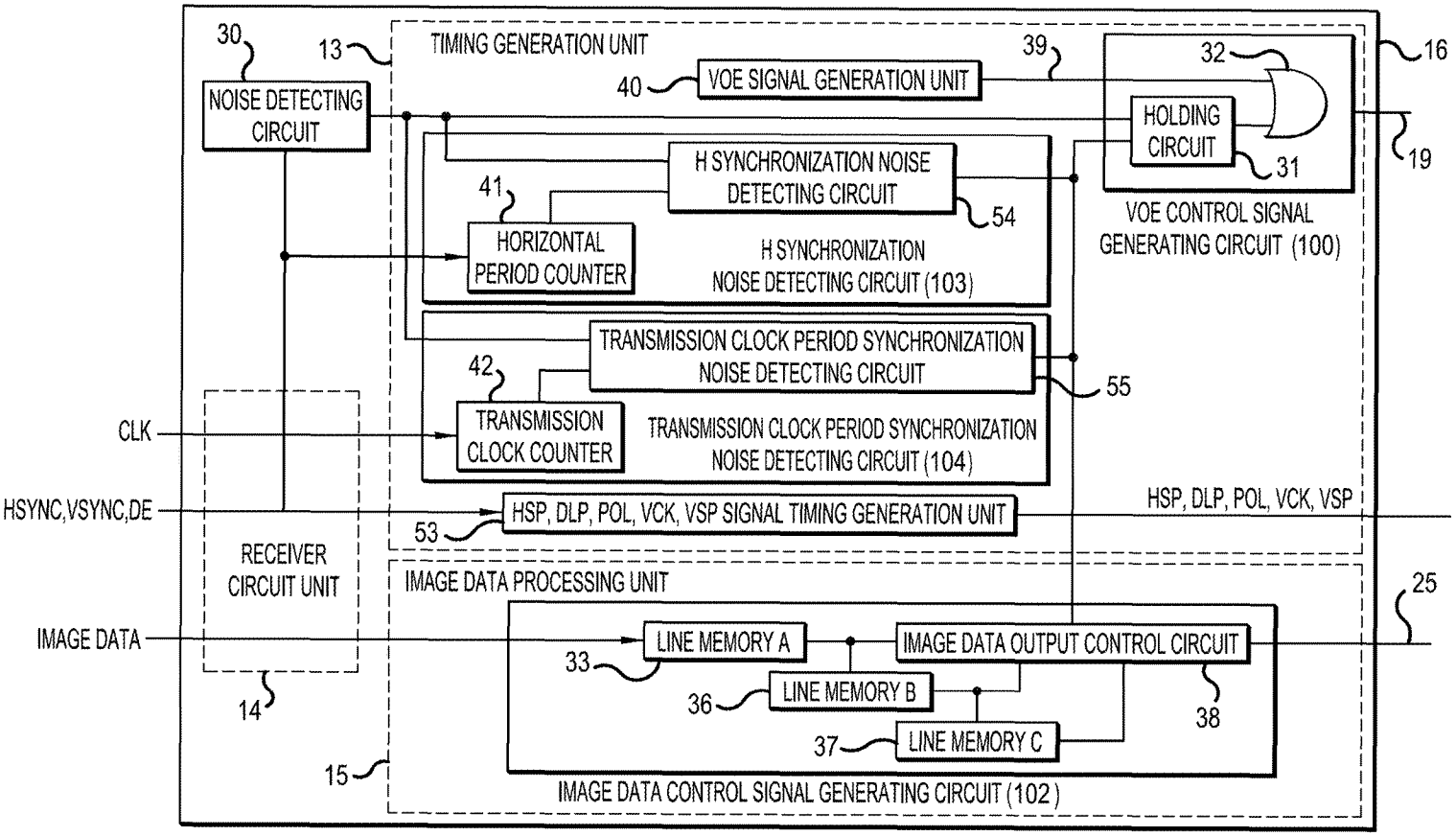
FIG. 12 is a configuration diagram of the timing controller in Example 4 of a display device according to the present invention.
Figure 13:
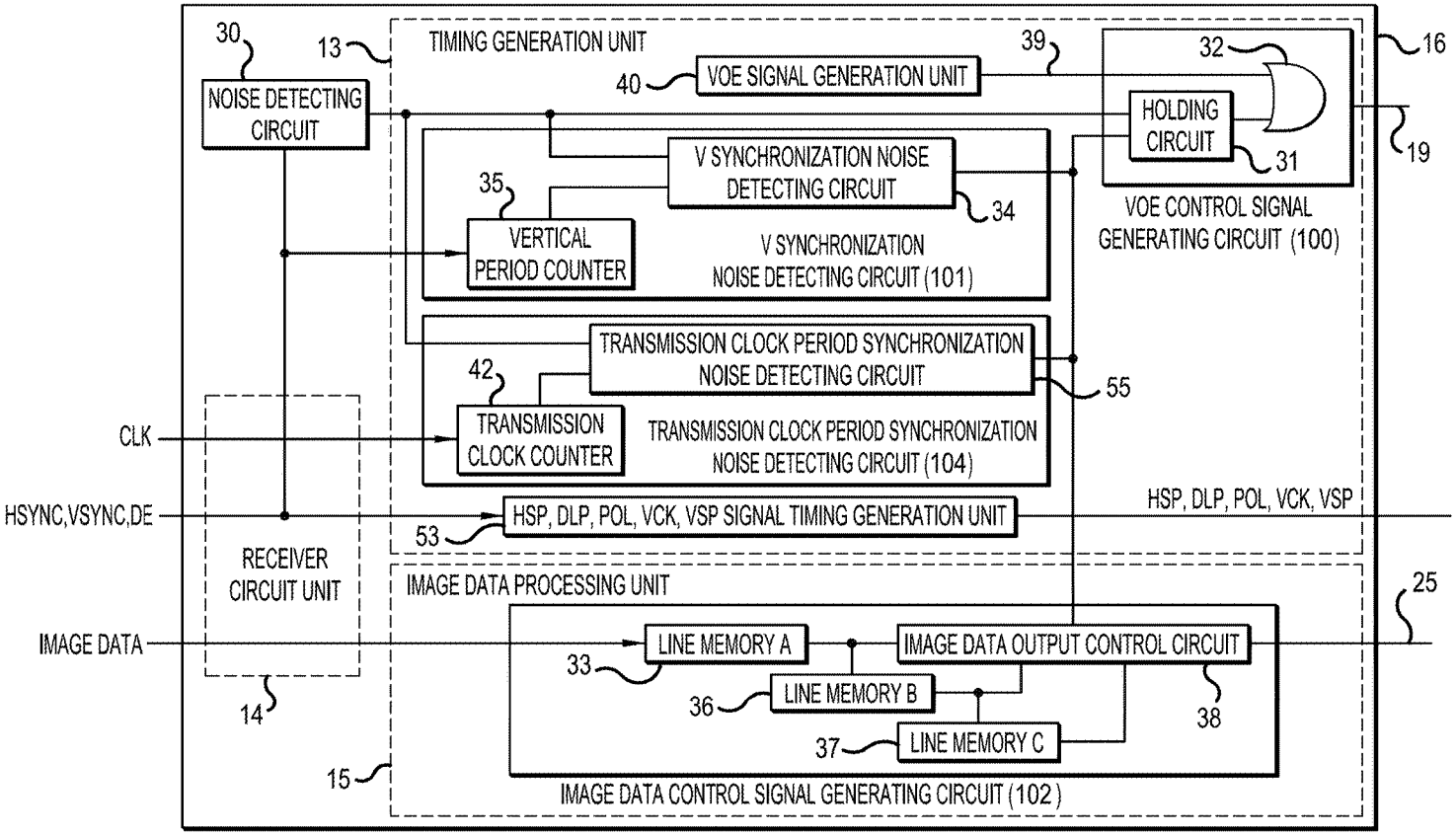
FIG. 13 is a configuration diagram of the timing controller in Example 4 of a display device according to the present invention.

Similarly, FIG. 11, FIG. 12, and FIG. 13 illustrate the configurations of timing controllers 16 in the case of simultaneously including the V synchronization noise detecting circuit 101 included in Example 1 as mentioned above and the H synchronization noise detecting circuit 103 included in Example 2, in the case of simultaneously including the H synchronization noise detecting circuit 103 included in Example 2 as mentioned above and the transmission clock period synchronization noise detecting circuit 104 included in Example 3, and in the case of simultaneously including the V synchronization noise detecting circuit 101 included in Example 1 as mentioned above and the transmission clock period synchronization noise detecting circuit 104 included in Example 3, respectively. In such cases, noise synchronized with each synchronizing signal and transmission clock can also be similarly detected.

Example 5

Figure 9:
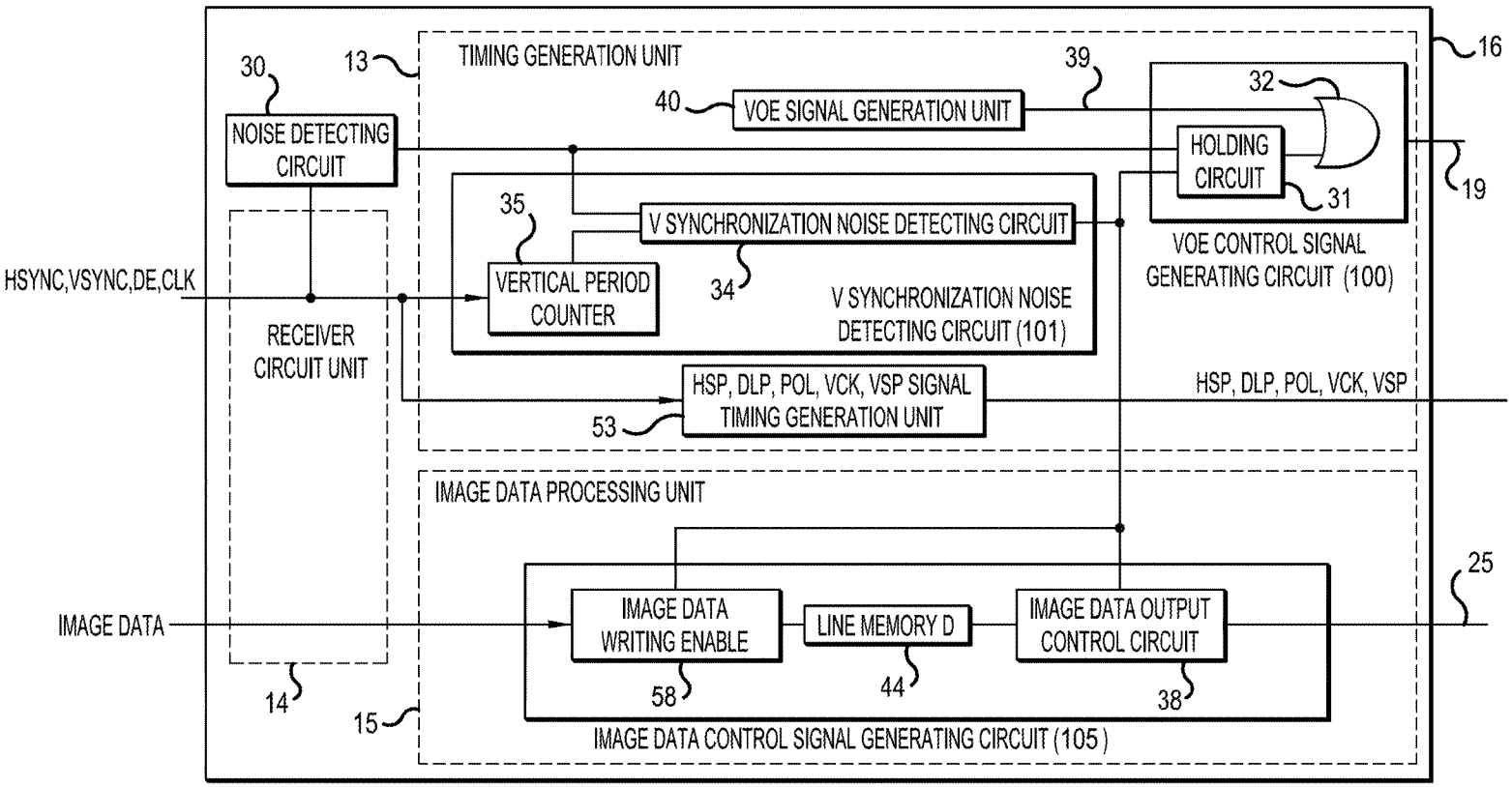
FIG. 9 is a configuration diagram of a timing controller in Example 5 of a display device according to the present invention.

FIG. 9 illustrates the configuration of a timing controller 16 in Example 5 of the present invention.

The line memory A33, the line memory B36, and the line memory C37 are included in the image data control signal generating circuit 102 in Example 1 as mentioned above. However, by only a line memory D44 and detecting noise to control writing in the line memory D44 in image data writing Enable 58, the same image data as image data prior to the time of the generation of the noise by one line can be outputted without being processed, and image data on which the noise is superimposed can be suppressed from influencing a display on a liquid crystal display.

Figure 17:
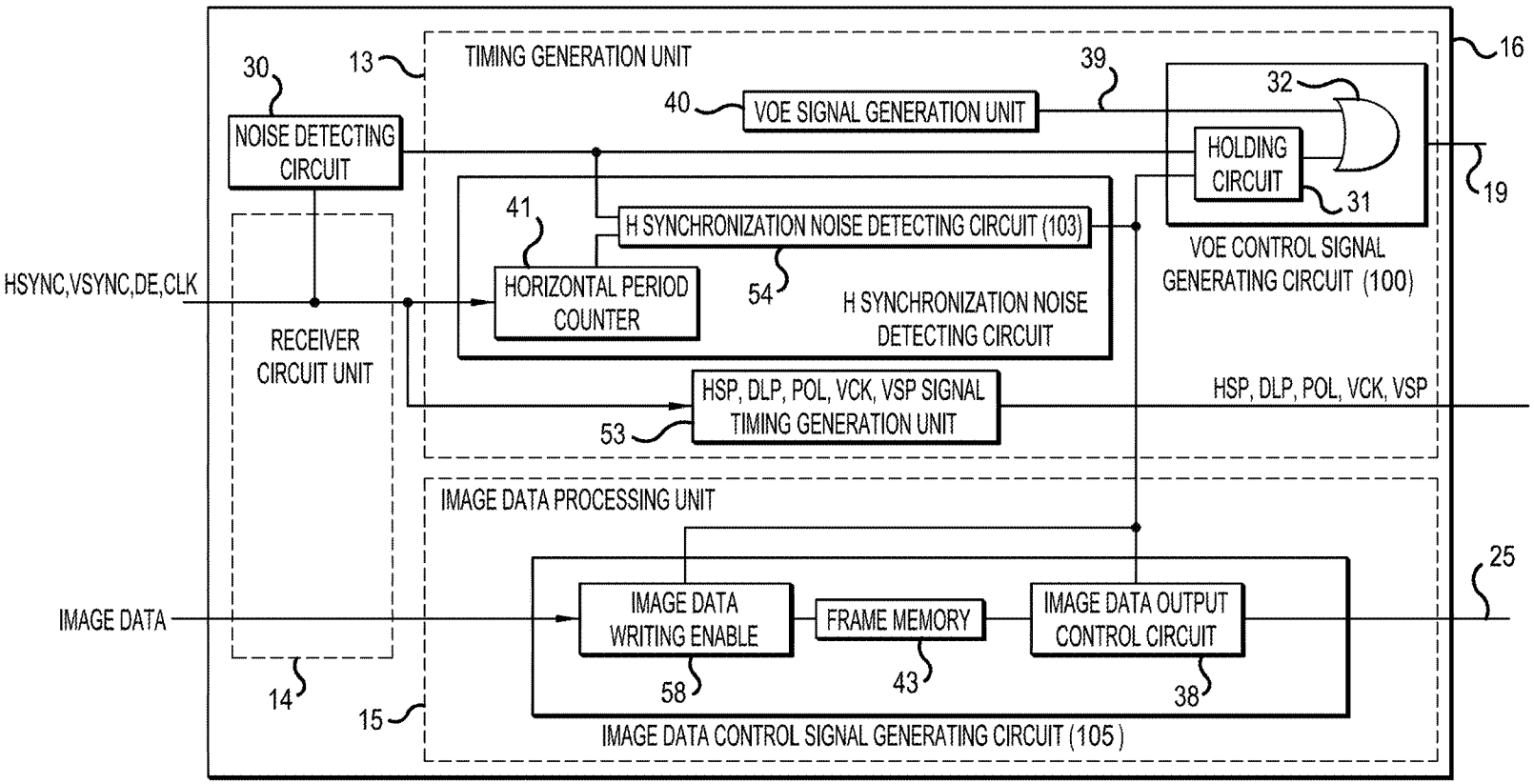
FIG. 17 is a configuration diagram of the timing controller in Example 5 of a display device according to the present invention.
Figure 18:
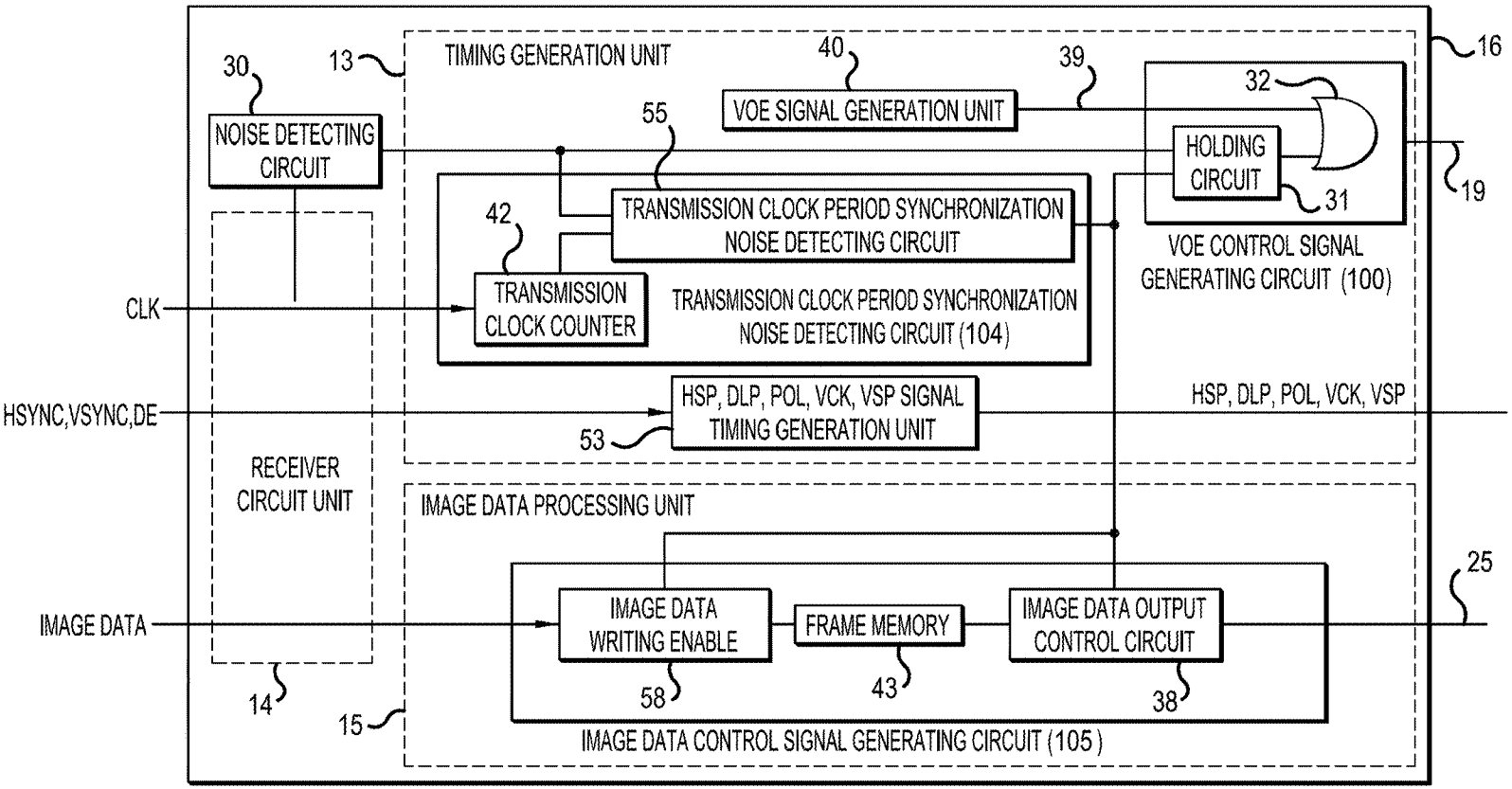
FIG. 18 is a configuration diagram of the timing controller in Example 5 of a display device according to the present invention.

In addition, FIG. 17 and FIG. 18 illustrate the configurations of timing controllers 16 in a case in which the configuration of the present example is carried out in Example 2 as mentioned above and in a case in which the configuration of the present example is carried out in Example 3 as mentioned above, respectively. Such cases can also be similarly carried out.

Example 6

Figure 10:
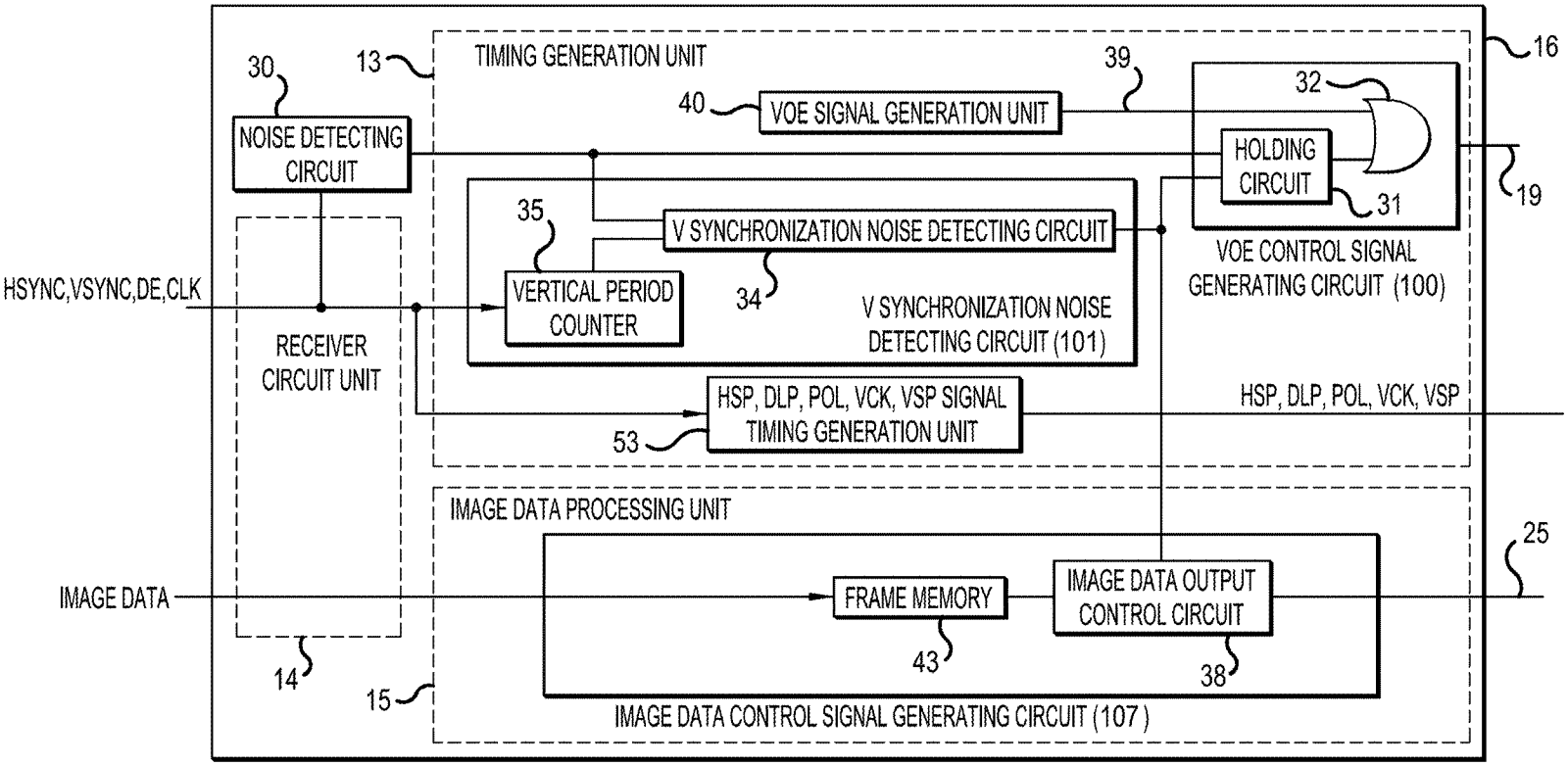
FIG. 10 is a configuration diagram of a timing controller in Example 6 of a display device according to the present invention.

FIG. 10 illustrates the configuration of a timing controller 16 in Example 6 of the present invention.

Figure 14:
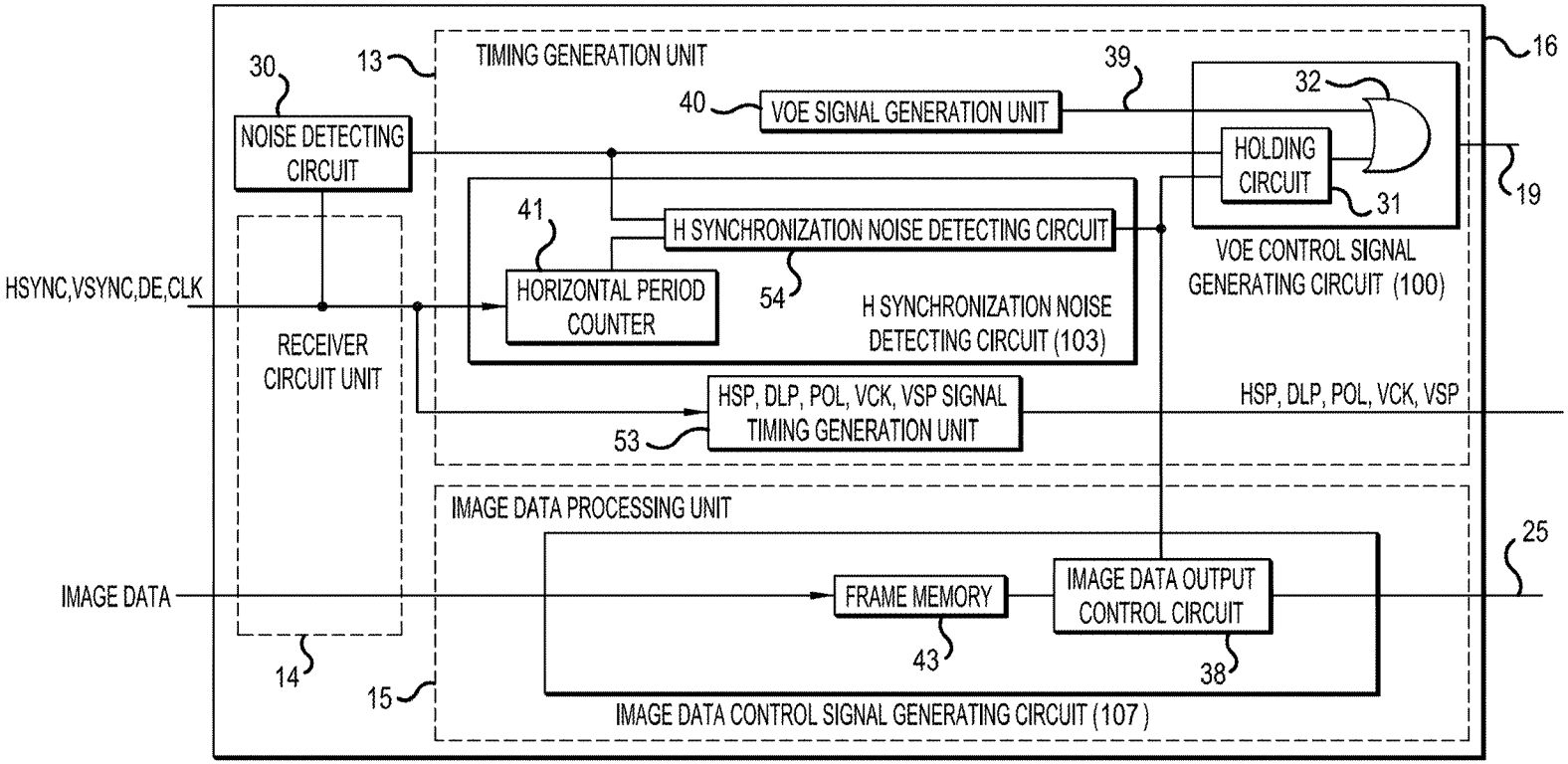
FIG. 14 is a configuration diagram of the timing controller in Example 6 of a display device according to the present invention.
Figure 15:
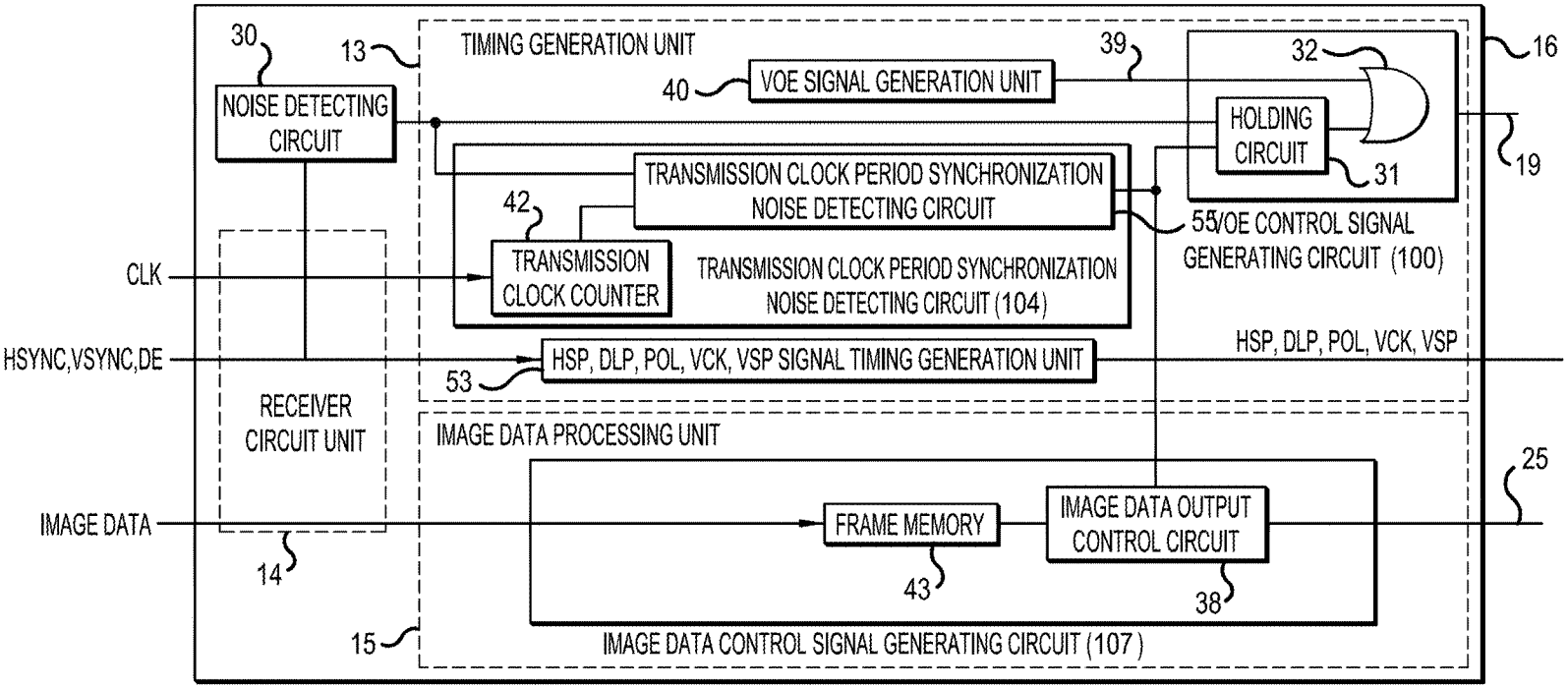
FIG. 15 is a configuration diagram of the timing controller in Example 6 of a display device according to the present invention.

The line memory A, the line memory B, and the line memory C are included in the image data control signal generating circuit 102 in Example 1 as mentioned above. However, by a frame memory 43, the same image data as image data prior to the time of the generation of the noise by one frame can be outputted without being processed, and image data on which the noise is superimposed can be suppressed from influencing a display on a liquid crystal display. In addition, FIG. 14 and FIG. 15 illustrate the configurations of timing controllers 16 in a case in which the configuration of the present example is carried out in Example 2 as mentioned above and in a case in which the configuration of the present example is carried out in Example 3 as mentioned above, respectively. Such cases can also be similarly carried out.

REFERENCE SIGNS LIST

1 Liquid-crystal display device
2 Liquid crystal display
3 Scanning line electrode driving circuit
6 Signal line electrode driving circuit
8 Signal line driving source driver IC
9 Scanning line driving gate driver IC
12 Timing controller
13 Timing generation unit
14 Receiver circuit unit
15 Image data processing unit
16 Timing controller
17 Signal line electrode
18 Scanning line electrode
19 Output enable control signal VOE
25 Output image data
26 Image data signal
30 Noise detecting circuit
31 Holding circuit
33 Line memory A
34 V synchronization noise detecting circuit
35 Vertical period counter
36 Line memory B
37 Line memory C
38 Image data output control circuit
39 Control signal VOE
40 VOE signal generation unit
41 Horizontal period counter
42 Transmission clock counter
43 Frame memory
44 Line memory D
50 Thin film transistor (TFT)
51 Liquid crystal cell
52 Capacitor
53 Timing generation unit
54 H synchronization noise detecting circuit
55 Transmission clock period synchronization noise detecting circuit
56 Synchronizing signal
58 Image data writing Enable
57 Noise signal
59 Normal synchronizing signal
100 VOE control signal generating circuit
101 V synchronization noise detecting circuit
102, 105, 107 Image data control signal generating circuit
103 H synchronization noise detecting circuit
104 Transmission clock period synchronization noise detecting circuit

What is claimed is:

1. A timing controller that controls a gate driver including a plurality of scan lines, the timing controller comprising:

a noise detecting circuit configured to detect a signal with noise at a scan line of the scan lines; and a V synchronization noise detecting circuit configured to determine whether the signal with noise is repeatedly detected at a same scan line in each vertical period, wherein the timing controller is controlled to:

stop an operation of the gate driver when the noise detecting circuit detects the signal with noise at the same scan line and the V synchronization noise detecting circuit determines that the signal with noise is not repeatedly detected at the same scan line; and continue the operation of the gate driver when the noise detecting circuit detects the signal with noise at the same scan line and the V synchronization noise detecting circuit determines that the signal with noise is repeatedly detected at the same scan line.

2. A timing controller that controls a source driver including a plurality of signal lines, the timing controller comprising:

a noise detecting circuit configured to detect a signal with noise at a signal line of the signal lines; and an H synchronization noise detecting circuit configured to determine whether the signal with noise is repeatedly detected at a same signal line in each horizontal period, wherein the timing controller is controlled to:

stop an operation of a gate driver when the noise detecting circuit detects the signal with noise at the same signal line and the H synchronization noise detecting circuit determines that the signal with noise is not repeatedly detected at the same signal line; and continue the operation of the gate driver when the noise detecting circuit detects the signal with noise at the same signal line and the H synchronization noise detecting circuit determines that the signal with noise is repeatedly detected at the same signal line.

3. A timing controller that controls a source driver and a gate driver, the timing controller comprising:

a noise detecting circuit configured to detect a transmission clock synchronization signal with noise from an input signal; and a transmission clock synchronization noise detecting circuit configured to determine whether the transmission clock synchronization signal with noise is repeatedly detected in each transmission clock period, wherein the timing controller is controlled to:

stop an operation of the gate driver when the noise detecting circuit detects the transmission clock synchronization signal with noise in the input signal and the transmission clock synchronization noise detecting circuit determines that the transmission clock synchronization signal with noise is not repeatedly detected in each transmission clock period; and continue the operation of the gate driver when the noise detecting circuit detects the transmission clock synchronization signal with noise and the transmission clock synchronization noise detecting circuit determines that the transmission clock synchronization signal with noise is repeatedly detected in each transmission clock period.

4. The timing controller according to claim 1, wherein the timing controller further controls a source driver including a plurality of signal lines, wherein the noise detecting circuit is further configured to detect an other signal with noise at a signal line of the signal lines, wherein an H synchronization noise detecting circuit is provided configured to determine whether the other signal with noise is repeatedly detected at a same signal line in each horizontal period, and wherein the timing controller is further controlled to:

stop the operation of the gate driver when the noise detecting circuit detects the other signal with noise at the same signal line and the H synchronization noise detecting circuit determines that the other signal with noise is not repeatedly detected at the same signal line; and continue the operation of the gate driver when the noise detecting circuit detects the other signal with noise at the same signal line and the H synchronization noise detecting circuit determines that the other signal with noise is repeatedly detected at the same signal line.

5. The timing controller according to claim 2, wherein said timing controller further controls the gate driver including a plurality of scan lines, wherein the noise detecting circuit is further configured to detect an other signal with noise at a scan line of the scan lines, wherein a V synchronization noise detecting circuit is provided configured to determine whether the other signal with noise at the scan line is repeatedly detected at a same scan line in each vertical period, and wherein said timing controller is further controlled to:

stop the operation of the gate driver when the noise detecting circuit detects the other signal with noise at the same scan line and the V synchronization noise detecting circuit determines that the other signal with noise is not repeatedly detected at the same scan line; and continue the operation of the gate driver when the noise detecting circuit detects the other signal with noise at the same scan line and the V synchronization noise detecting circuit determines that the other signal with noise is repeatedly detected at the same scan line.

6. The timing controller according to claim 2, wherein the noise detecting circuit is further configured to detect a transmission clock synchronization signal with noise from an input signal, wherein a transmission clock synchronization noise detecting circuit is provided configured to determine whether the transmission clock synchronization signal with noise is repeatedly detected in each transmission clock period, and wherein the timing controller is further controlled to:

stop the operation of the gate driver when the noise detecting circuit detects the transmission clock synchronization signal with noise in the input signal and the transmission clock synchronization noise detecting circuit determines that the transmission clock synchronization signal with noise is not repeatedly detected in each transmission clock period; and continue the operation of the gate driver when the noise detecting circuit detects the transmission clock synchronization signal with noise and the transmission clock synchronization noise detecting circuit determines that the transmission clock synchronization signal with noise is repeatedly detected in each transmission clock period.

7. The timing controller according to claim 3, wherein the source driver includes a plurality of signal lines, wherein the noise detecting circuit is further configured to detect an other signal with noise at a signal line of the signal lines, wherein an H synchronization noise detecting circuit is provided configured to determine whether the other signal with noise is repeatedly detected at a same signal line in each horizontal period, and wherein the timing controller is further controlled to:

stop the operation of the gate driver when the noise detecting circuit detects the other signal with noise at the same signal line and the H synchronization noise detecting circuit determines that the other signal with noise is not repeatedly detected at the same signal line; and continue the operation of the gate driver when the noise detecting circuit detects the other signal with noise at the same signal line and the H synchronization noise detecting circuit determines that the other signal with noise is repeatedly detected at the same signal line.

8. The timing controller according to claim 1, wherein the noise detecting circuit is further configured to detect a transmission clock synchronization signal with noise from an input signal, wherein a transmission clock synchronization noise detecting circuit is provided configured to determine whether the transmission clock synchronization signal with noise is repeatedly detected in each transmission clock period, and wherein the timing controller is further controlled to:

stop the operation of the gate driver when the noise detecting circuit detects the transmission clock synchronization signal with noise in the input signal and the transmission clock synchronization noise detecting circuit determines that the transmission clock synchronization signal with noise is not repeatedly detected in each transmission clock period; and continue the operation of the gate driver when the noise detecting circuit detects the transmission clock synchronization signal with noise and the transmission clock synchronization noise detecting circuit determines that the transmission clock synchronization signal with noise is repeatedly detected in each transmission clock period.

9. The timing controller according to claim 3, wherein the gate driver includes a plurality of scan lines, wherein the noise detecting circuit is further configured to detect an other signal with noise a scan line of the scan lines, wherein a V synchronization noise detecting circuit is provided configured to determine whether the other signal with noise is repeatedly detected at a same scan line in each vertical period, and wherein the timing controller is further controlled to:

stop the operation of the gate driver when the noise detecting circuit detects the other signal with noise at the same scan line and the V synchronization noise detecting circuit determines that the other signal with noise is not repeatedly detected at the same scan line; and continue the operation of the gate driver when the noise detecting circuit detects the other signal with noise at the same scan line and the V synchronization noise detecting circuit determines that the other signal with noise is repeatedly detected at the same scan line.

10. A display device comprising the timing controller according to claim 1.

11. A display device comprising the timing controller according to claim 2.

12. A display device comprising the timing controller according to claim 3.

* * * * *